US006565363B2

(12) United States Patent
Downing

(10) Patent No.: US 6,565,363 B2
(45) Date of Patent: May 20, 2003

(54) MAGNETIC MODULAR JACK

(76) Inventor: Eric Downing, 30921 Orwell Rd., Ontario, WI (US) 54651

( * ) Notice: Subject to any disclaimer, the term of this patent is extended or adjusted under 35 U.S.C. 154(b) by 0 days.

(21) Appl. No.: 09/943,021

(22) Filed: Aug. 30, 2001

(65) Prior Publication Data

US 2003/0045134 A1 Mar. 6, 2003

(51) Int. Cl.[7] ..... H01R 11/30
(52) U.S. Cl. ..... 439/39; 439/38
(58) Field of Search ..... 439/39, 38

(56) References Cited

U.S. PATENT DOCUMENTS 3,808,577 A * 4/1974 Mathauser ..... 439/39
3,868,160 A * 2/1975 Kersman ..... 439/39
5,401,175 A * 3/1995 Guimond et al. ..... 439/38

* cited by examiner

*Primary Examiner*—Renee Luebke
*Assistant Examiner*—Ann McCamey
(74) *Attorney, Agent, or Firm*—Michael I. Kroll

(57) ABSTRACT

Disclosed is a modular jack system that utilizes magnetic attraction to draw a plug 16 into a jack 18 and then maintain it therein. The modular jack system utilizes plug 16 and jack 18 having at least one pair of cooperating magnets 30, 32 polarized so that the magnets on the plug 16 are drawn to the magnets on the jack 18 thereby pulling the plug 16 into the proper connected position and maintaining it therein. Installation of the plug 16 into the jack 18 is simplified because the magnets will guide the plug 16 into the jack 18 once in the proximity thereof The system could also be adapted for use with other similar applications such as coaxial cable 44 connections to replace the threaded and slip-on types of connections known in the prior art.

6 Claims, 13 Drawing Sheets

MAGNETIC MODULAR JACK

BACKGROUND OF THE INVENTION

1. Field of the Invention

The present invention relates generally to cable connections and more specifically to a modular jack system that utilizes magnetic attraction to draw a plug into a jack and then maintain it therein. The present invention could be applied to any low voltage electrical connection but the preferred application is to be used with voice and data cables. Telecommunication modular plugs shown in the prior art have a snap-in clip type locking mechanism that must be manually compressed by the user in order to remove the plug from the jack. The clip portion of the locking mechanism frequently breaks off and renders the locking mechanism useless and the plug will then slide out of the jack in response to the slightest movement of the cable. Another inherent disadvantage of the modular plug of the prior art is the rigidity of the locking mechanism that could either break the locking clip or undermine the integrity of the cable/plug connection when a force is applied to the related cable. Furthermore, it is possible for someone to trip over a cable that is firmly locked into a wall jack and an injury could result. Therefore the present invention seeks to overcome these and other disadvantages of the prior art by providing a magnetic modular jack system wherein the plug and the jack have at least one pair of cooperating magnets polarized so that the magnets on the plug are drawn to the magnets on the jack thereby pulling the plug into the inserted connected position and maintaining it therein. Installation of the plug into the jack is simplified because the magnets will guide the plug therein once in the proximity thereof. Loose connections are eliminated because the magnets hold the plug firmly within the jack and are not susceptible to the slack commonly found in conventional modular plugs. Furthermore, removing the plug from the jack is simplified because the user only has to pull the cable with enough force to disengage the magnetic bond and does not have to depress a clip on a plug in a difficult to access wall jack or component.

The present invention could also be adapted for use with other similar applications such as coaxial cable connections to replace the threaded and slip-on types of connections known in the prior art.

2. Description of the Prior Art

There are other magnetic connection devices. Typical of these is U.S. Pat. No. 4,112,941 issued to Frank Larimore on Sep. 12, 1978 and U.S. Pat. No. 5,004,425 issued to Roland Hee on Apr. 2, 1991.

U.S. Pat. No. 5,004,425

Inventor: Roland Hee

Issued: Apr. 2, 1991

A magnetic connection assembly for releasably connecting a ground cord to an electrically conductive body band. Said assembly comprising a first connection member electrically connected to one end of a ground cord and a second connection member electrically connected to a body band. The first and second connection members are at least partially formed of electrically conductive material and are correspondingly sized and configured so as to be relatively positionable in a "coupled" relation, whereby electrical contact is maintained therebetween. At least one magnet is positioned in at least one of the first and second connection members so as to create sufficient magnetic attraction therebetween to hold the first and second connection members in their "coupled" relation without the need for frictional or spring loaded snaps and the like.

U.S. Pat. No. 4,112,941

Inventor: Frank Laramie

Issued: Sep. 12, 1978

An improved biomedical electrode and connector assembly is disclosed wherein the connector contains a magnet to facilitate mating with an elongated upstanding contact member of the electrode. Electrical contact between the connector and the electrode occurs along some portion of the upstanding contact member so that a space or gap is formed between the connector and the electrode plate of the electrode. Apparatus whereby the connector may be intentionally disconnected with ease, but accidental disconnection is prevented, are also provided.

While these magnetic connection devices may be suitable for the purposes for which they were designed, they would not be as suitable for the purposes of the present invention, as hereinafter described.

SUMMARY OF THE PRESENT INVENTION

The present invention discloses a modular jack system that utilizes magnetic attraction to draw a plug into a jack and then maintain it therein. The present invention discloses a magnetic modular jack system wherein the plug and the jack have at least one pair of cooperating magnets polarized so that the magnets on the plug are drawn to the magnets on the jack thereby pulling the plug into the proper connected position and maintaining it therein. Installation of the plug into the jack is simplified because the magnets will guide the plug into the jack when placed in proximity thereto. The present invention could also be adapted for use with other similar applications such as coaxial cable connections to replace the threaded and slip-on types of connections known in the prior art.

A primary object of the present invention is to provide a cable connection means utilizing magnets on each component that cooperate with one another to maintain a solid connection without the use of clips, threads or other conventional means.

Another object of the present invention is to provide a magnetic modular jack system for voice and data transmission cables such as telephone lines.

Yet another object of the present invention is to provide a magnetic coupling system that can be adapted for coaxial cable and other such applications.

Still yet another object of the present invention is to provide a magnetic modular jack system wherein the plug has a first substantially vertical magnet and a second substantially horizontal magnet, each magnet having a corresponding magnet similarly located on the jack with the polarities of the respective magnets arranged so as to cause an attraction and a magnetic bond once contact is made.

Another object of the present invention is to provide a magnetic modular jack system that has quick disconnect capabilities wherein the magnetic connection is separated when a substantial force is applied to the cable thereby allowing a user to disconnect the plug by gently pulling the cable without having to reach all the way to the jack which may be located in an area that is difficult to access.

Yet another object of the present invention is to provide a magnetic modular jack system that improves safety if someone walking catches the cable with their foot because the quick disconnect capabilities will disengage the plug from the jack rather than trip the person.

Still yet another object of the present invention is to provide a magnetic modular jack system that is simple and easy to use.

Another object of the present invention is to provide a magnetic modular jack system that is economical in cost to manufacture.

Additional objects of the present invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views in which.

LIST OF REFERENCE NUMERALS

Figure 1:
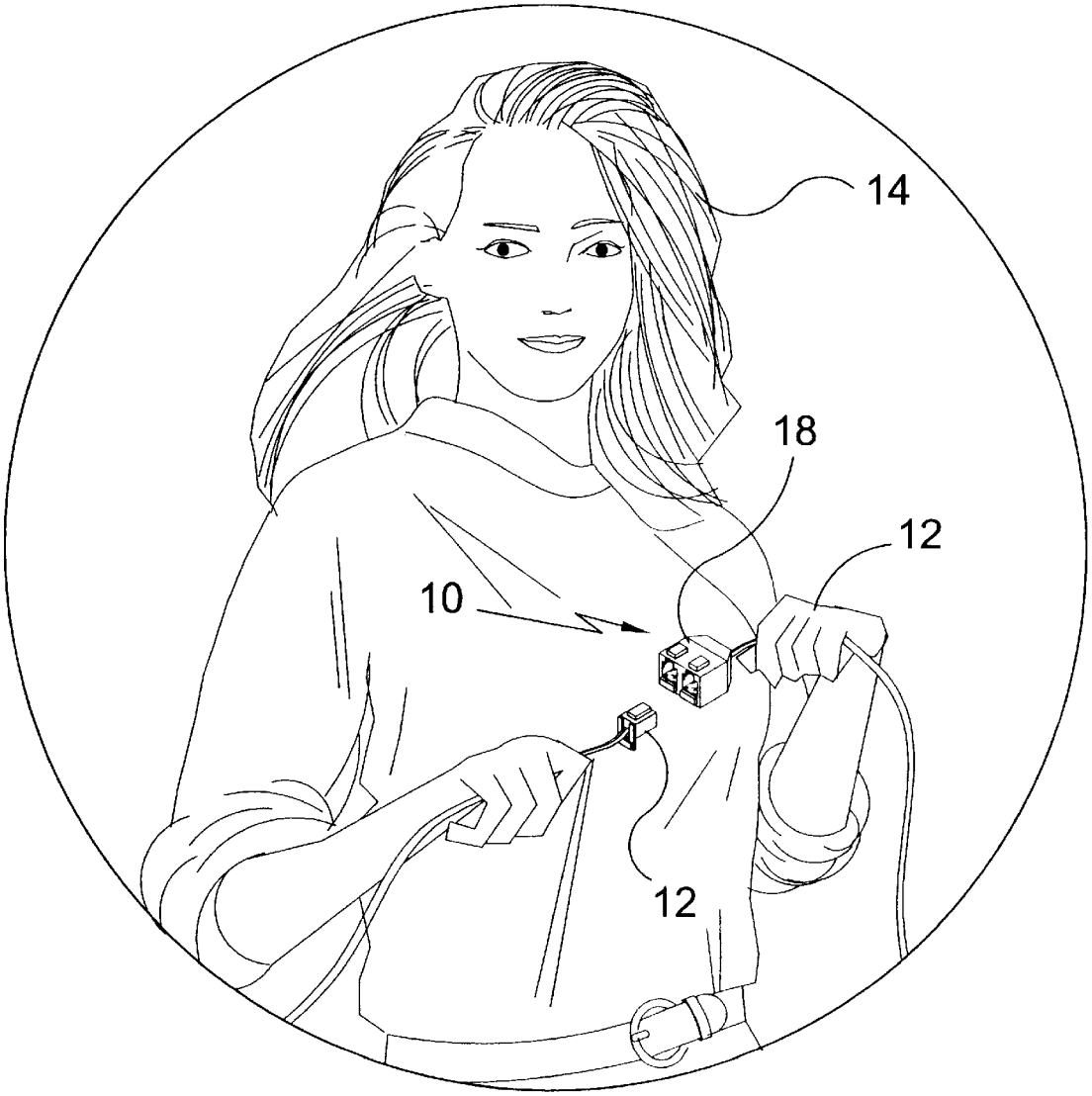
FIG. 1 is a perspective view of the present invention in use.

With regard to reference numerals used, the following numbering is used throughout the drawings.

10 present invention
12 hands
14 user
16 plug
18 jack
20 prior art plug
22 prior art jack
24 voice/data cable
26 destination cable
28 retaining clip
30 vertical magnets
32 horizontal magnets
34 mounting bracket
36 connector pin
38 connector plate
40 magnetic field
42 force vector
44 coaxial cable
46 pin connection
48 male connector
50 female connector
52 magnetic collar
54 male insertion member
56 female insertion member
58 cable insulation

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10 in the hands 12 of a user 14 plugging a magnetic modular plug 16 into a duplex modular jack 18 that has corresponding magnets polarized in a manner that will form a magnetic bond therebetween once the plug 16 is placed in proximity thereto.

Figure 2:
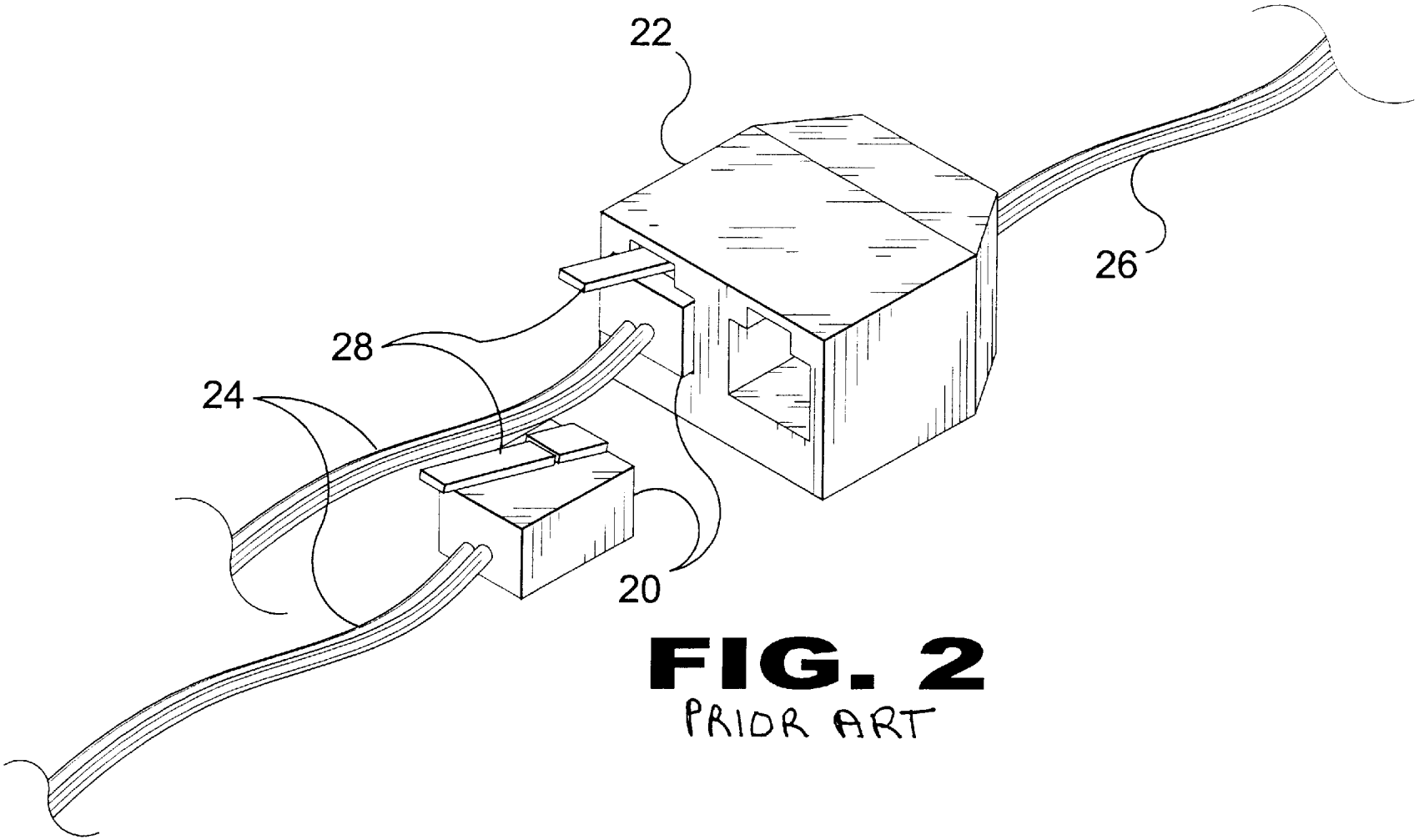
FIG. 2 PRIOR ART
FIG. 2 is a perspective view of the prior art.

Turning to FIG. 2, shown therein is a perspective view of the prior art showing a typical modular male plug 20 and female jack 22 that is commonly used with cables 24 for voice and data transmission. This is a RJ-11/14 type which is standard for the common modular telephone connection. Also shown is the destination wire/cable 26 and the plug retaining clip 28 which must be manually compressed for removal from the plug 20.

Figure 3:
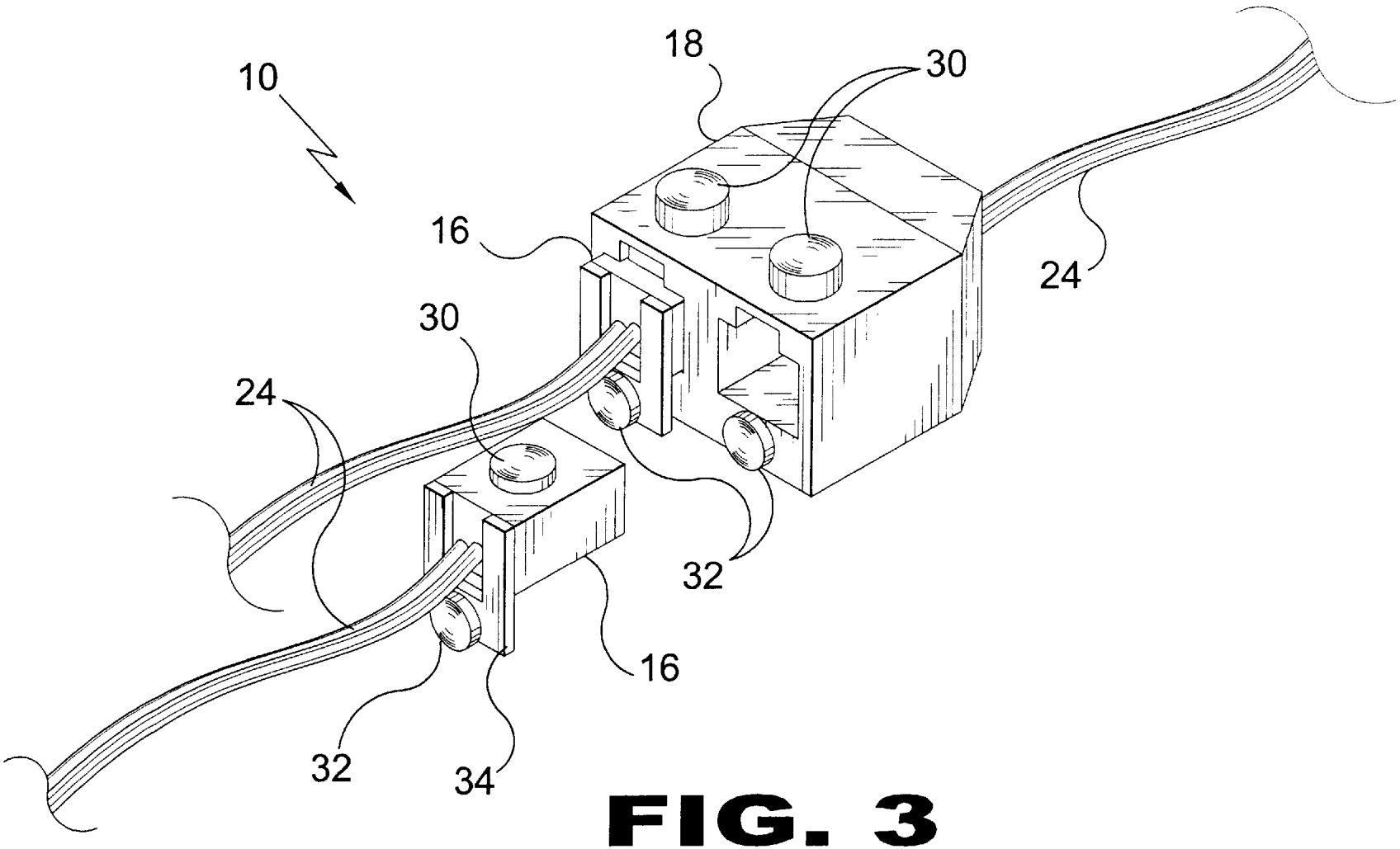
FIG. 3 is a perspective view of the present invention.

Turning to FIG. 3, shown therein is a perspective view of the present invention 10 showing one modular plug 16 inserted into the modular duplex jack 18 and one modular plug 16 ready for insertion. This would also be a RJ-11/14 type plug without clip 28. Each modular plug 16 has a substantially round, vertical magnet 30 and a substantially horizontal round magnet 32 that are attracted to corresponding magnets 30, 32 of an opposite polarity located on the jack 18. Voice/data cables 24 are also shown. A mounting bracket 34 is also shown for attachment of the magnet to plug 16.

Figure 4:
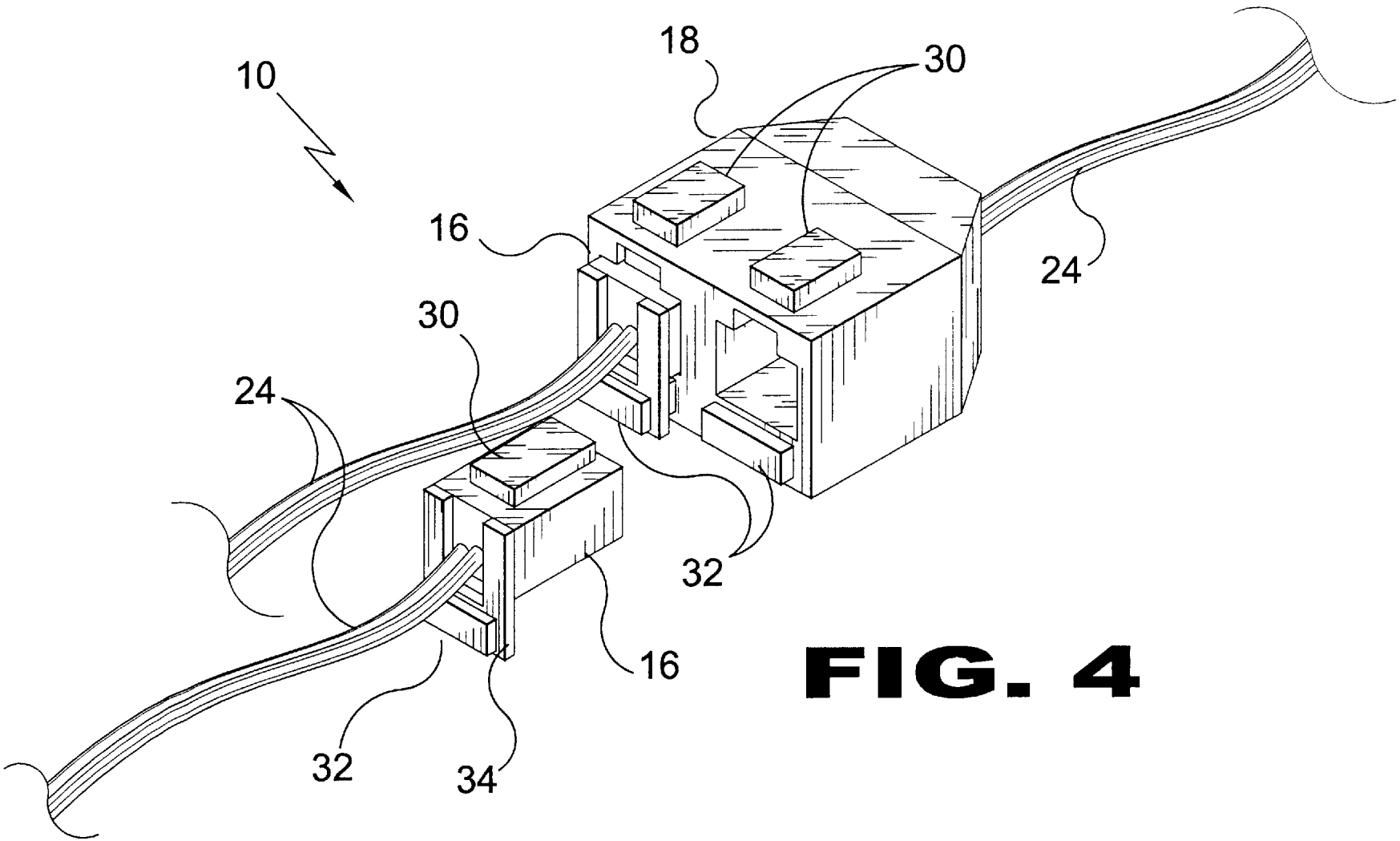
FIG. 4 is a perspective view of the present invention.

Turning to FIG. 4, shown therein is a perspective view of the present invention 10 wherein each modular plug 16 has a substantially vertical rectangular magnet 30 and a substantially horizontal rectangular magnet 32 that are attracted to corresponding magnets located on the jack. Voice/data cables 24 and downwardly extending mounting bracket 34 are also shown.

Figure 5:
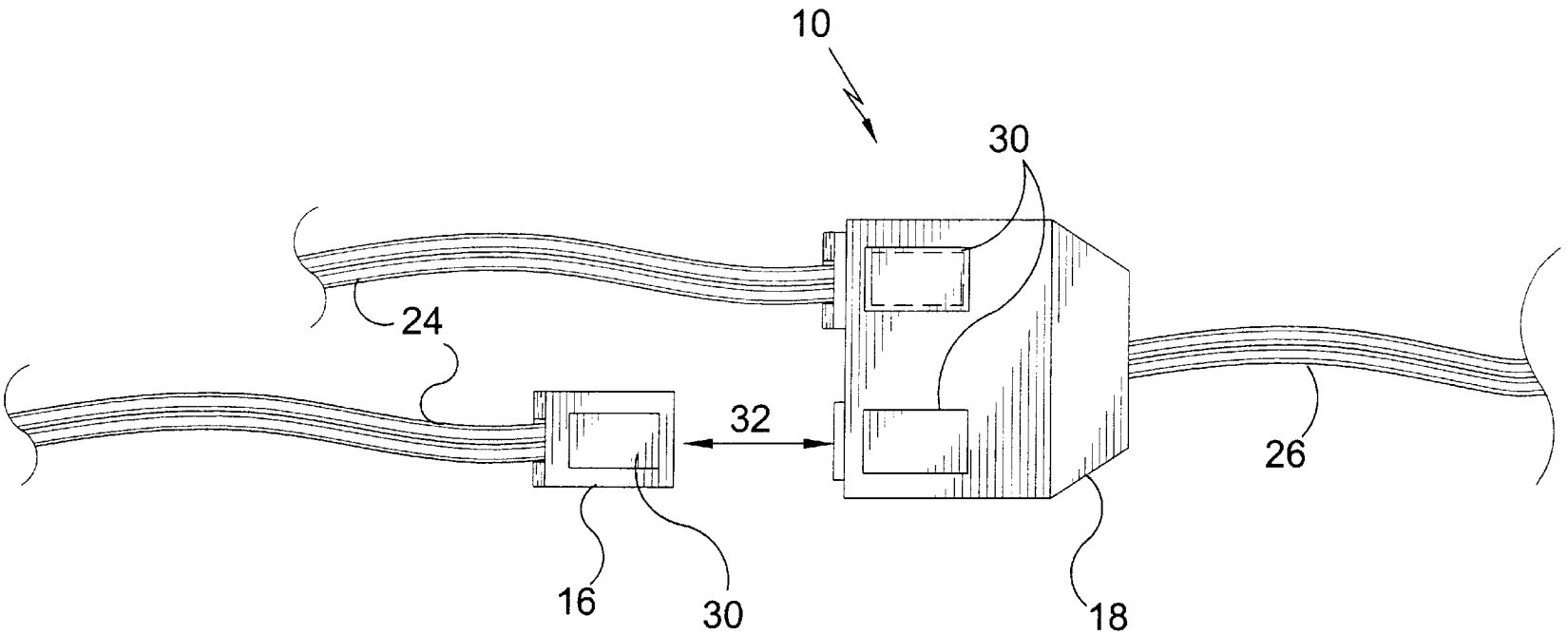
FIG. 5 is a top view of the present invention.

Turning to FIG. 5, shown therein is a top view of the present invention 10 showing the modular plug 16 and jack 18 along with magnets 30, 32 and cables 24, 26.

Figure 6:
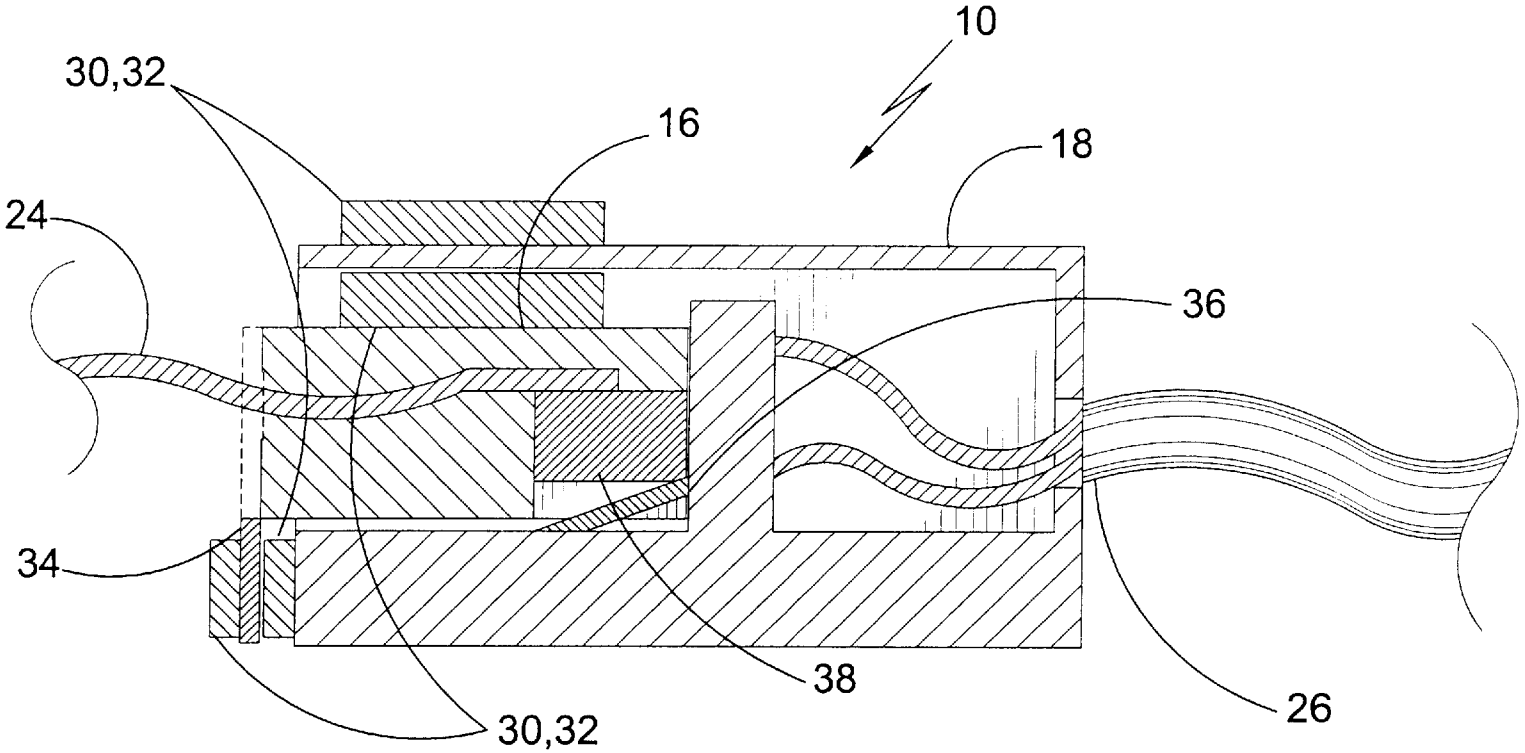
FIG. 6 is a cross-sectional side view of the present invention.

Turning to FIG. 6, shown therein is a cross sectional side view of the present invention 10. The magnets 30, 32 of the modular jack 18 of the present invention are aligned with the corresponding magnets 30, 32 on the modular plug 16 so as to form a magnetic bond to hold the plug 16 firmly in place and maintain a solid electrical connection between the connector pins 36 and the connector plates 38. Also shown are the mounting bracket 34 and cables 24, 26.

Figure 7:
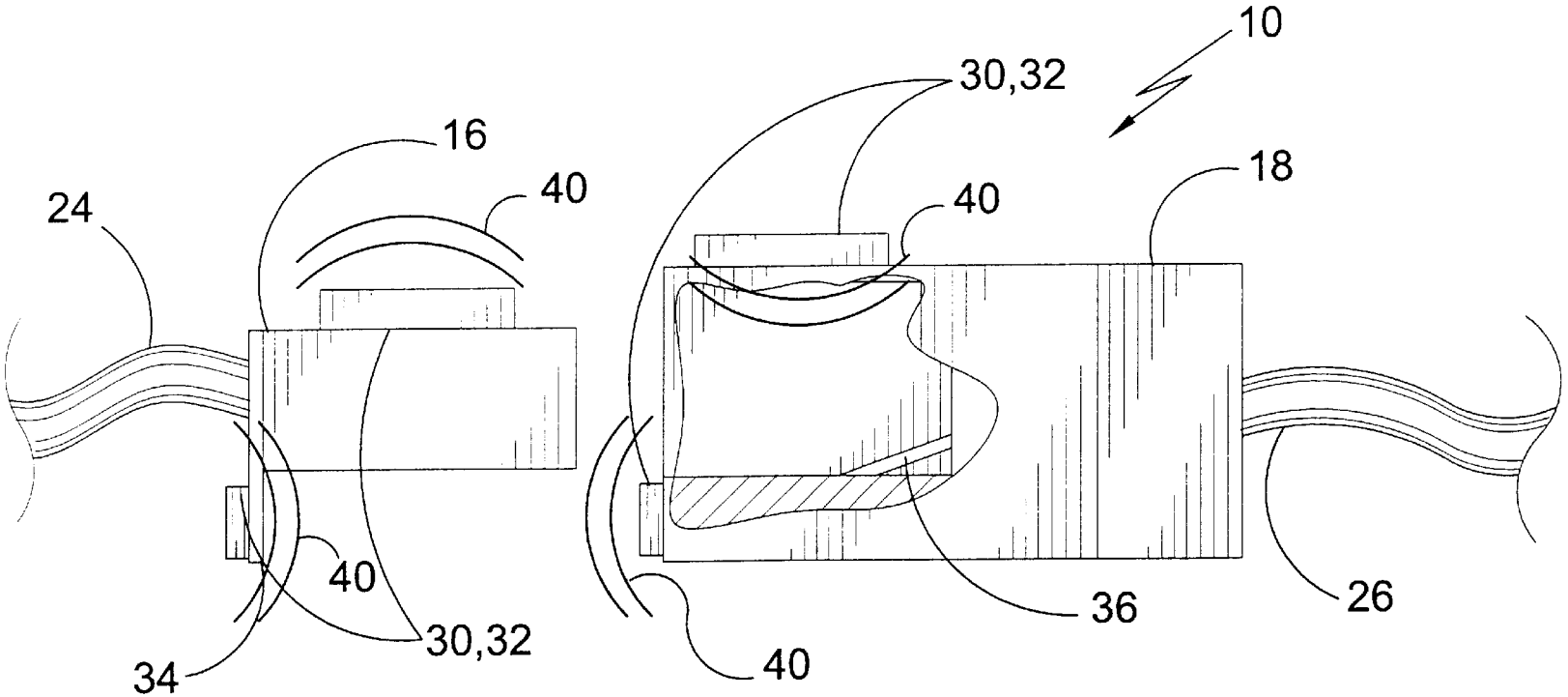
FIG. 7 is a cutaway side view of the present invention.

Turning to FIG. 7, shown therein is a cutaway view of the present invention 10. The modular plug 16 and the modular jack 18 are not connected and the magnetic fields 40 of their respective magnets 30, 32 are not influenced by one another. Also shown are the mounting bracket 34, connector pin 36, and cables 24, 26.

Figure 8:
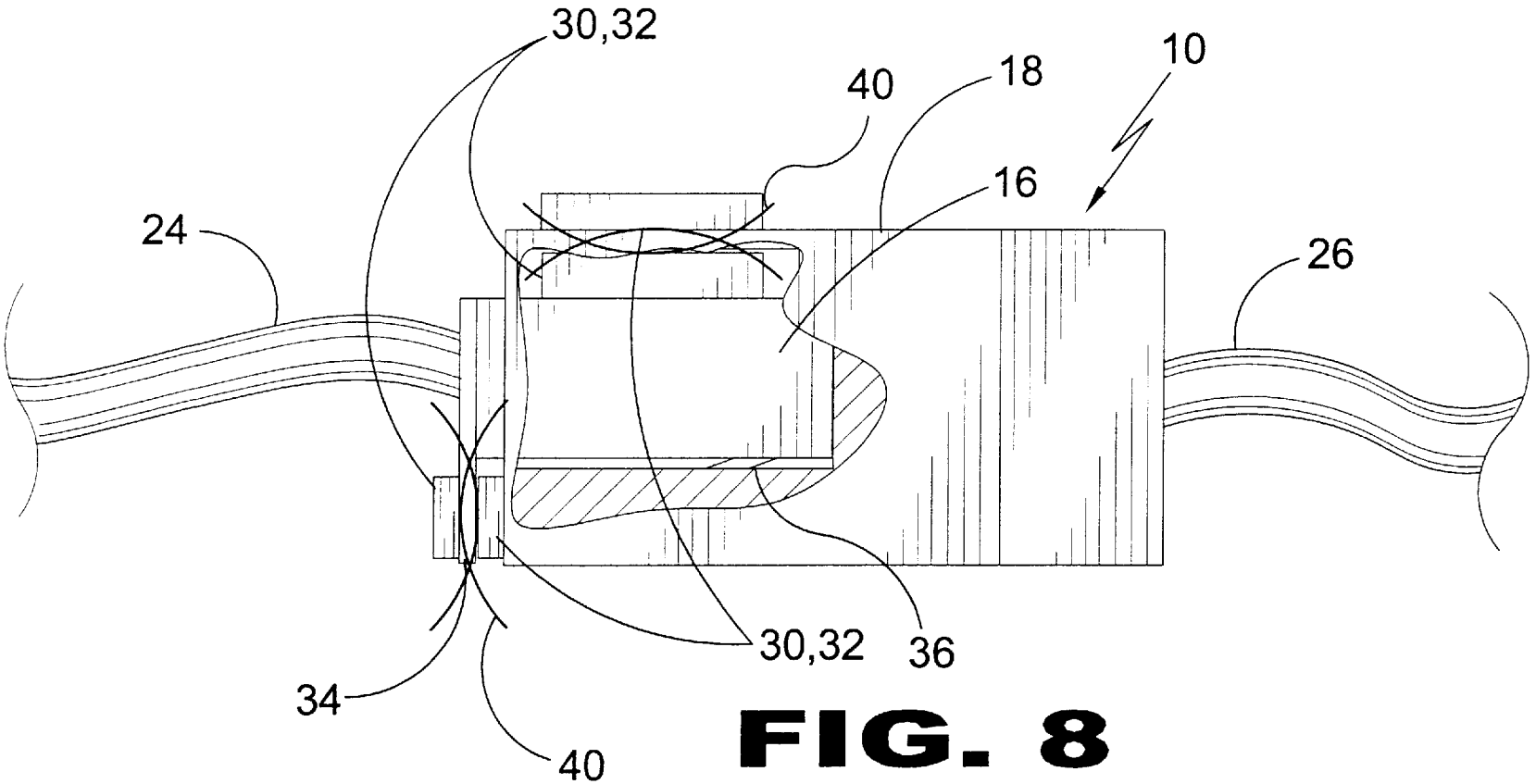
FIG. 8 is a cutaway side view of the present invention.

Turning to FIG. 8, shown therein is a sectional view of the present invention 10. The modular plug 16 is inserted into the modular jack 18 and the respective magnetic fields 40 of their respective magnets 30, 32 are influenced by one another to form two magnetic bonds (one horizontal, one vertical) to maintain the plug 16 firmly in place and insure a solid electrical connection. Also shown are the mounting bracket 34, connector pin 36, and cables 24, 26.

Figure 9:
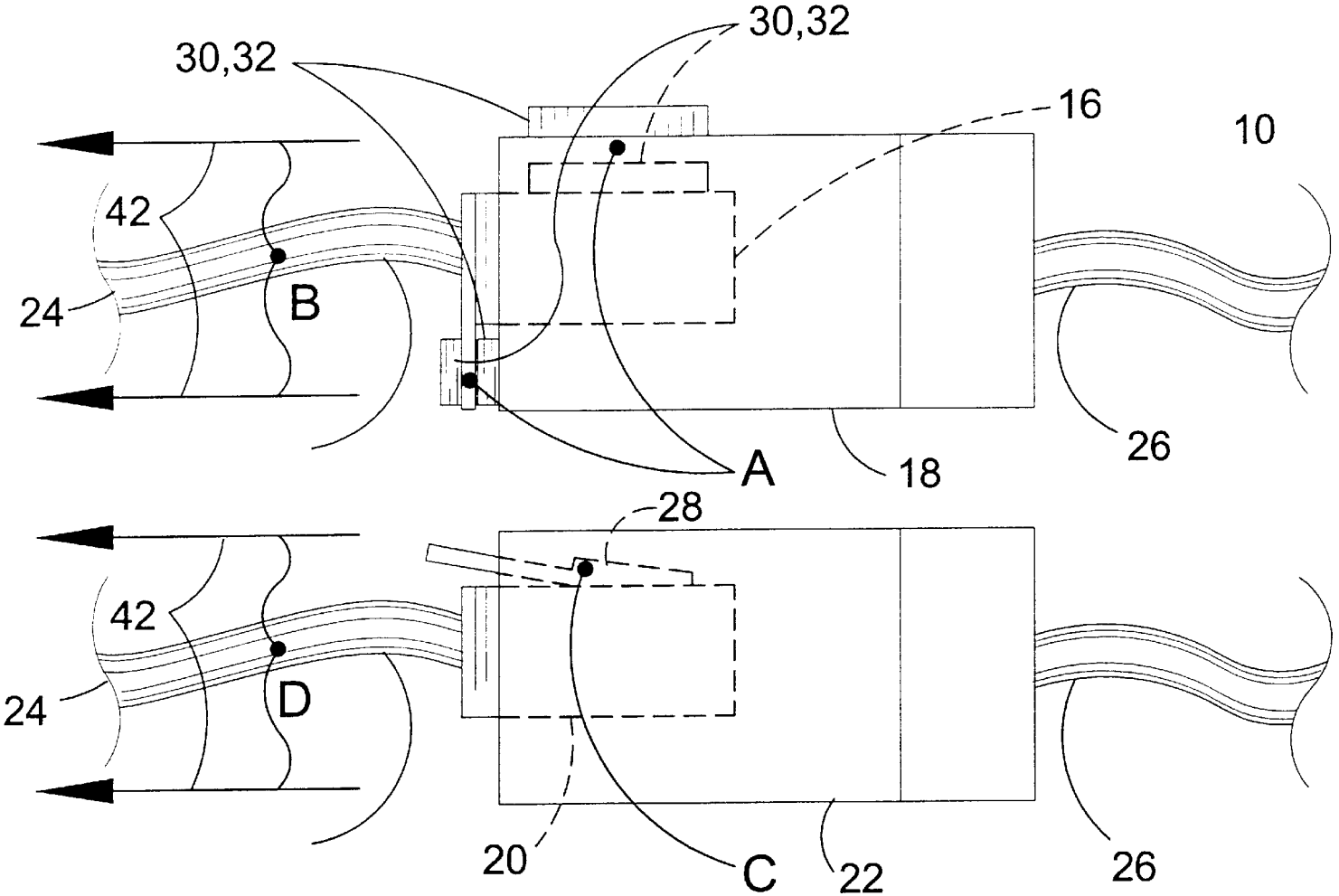
FIG. 9 is a side view of the present invention and the prior art.

Turning to FIG. 9, shown therein is a side view of the present invention 10 shown above the prior art 20, 22 to demonstrate a comparison showing that when a force vector 42 is applied to point B of the present invention 10 points A will release before damage to the unit 10 may occur. When a force vector 42 is applied to point D of the prior art 20, 22 either point D or point C will break or become damaged. Other elements previously disclosed are also shown.

Figure 10:
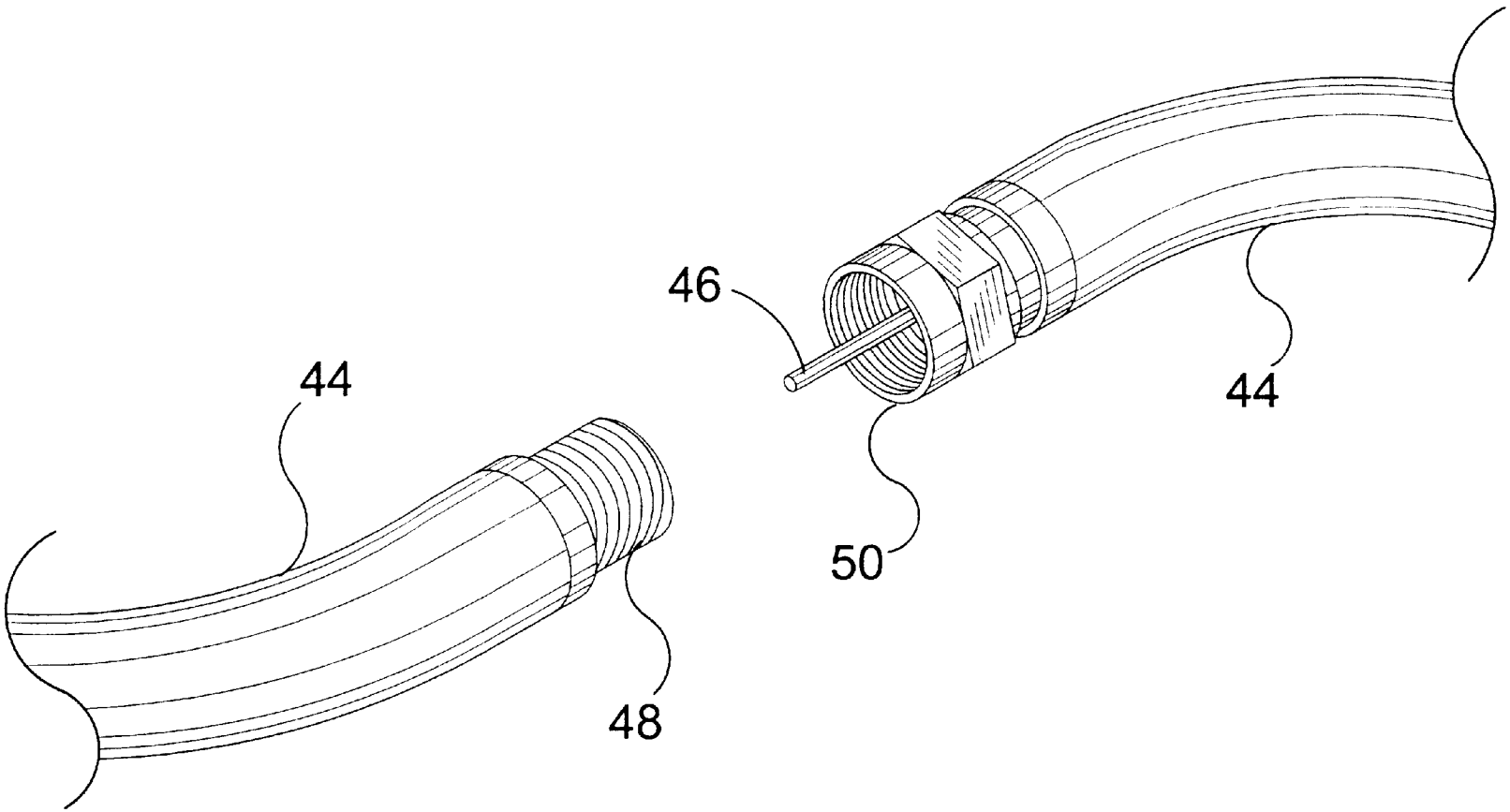
FIG. 10 PRIOR ART
FIG. 10 is a perspective view of the prior art.

Turning to FIG. 10, shown therein is a perspective view of the prior art showing the components and structure of a standard coaxial cable 44 and connection means showing a pin connector 46 and a male 48 screw-in connector and female 50 screw-in collar connector on the ends of cable 44.

Figure 11:
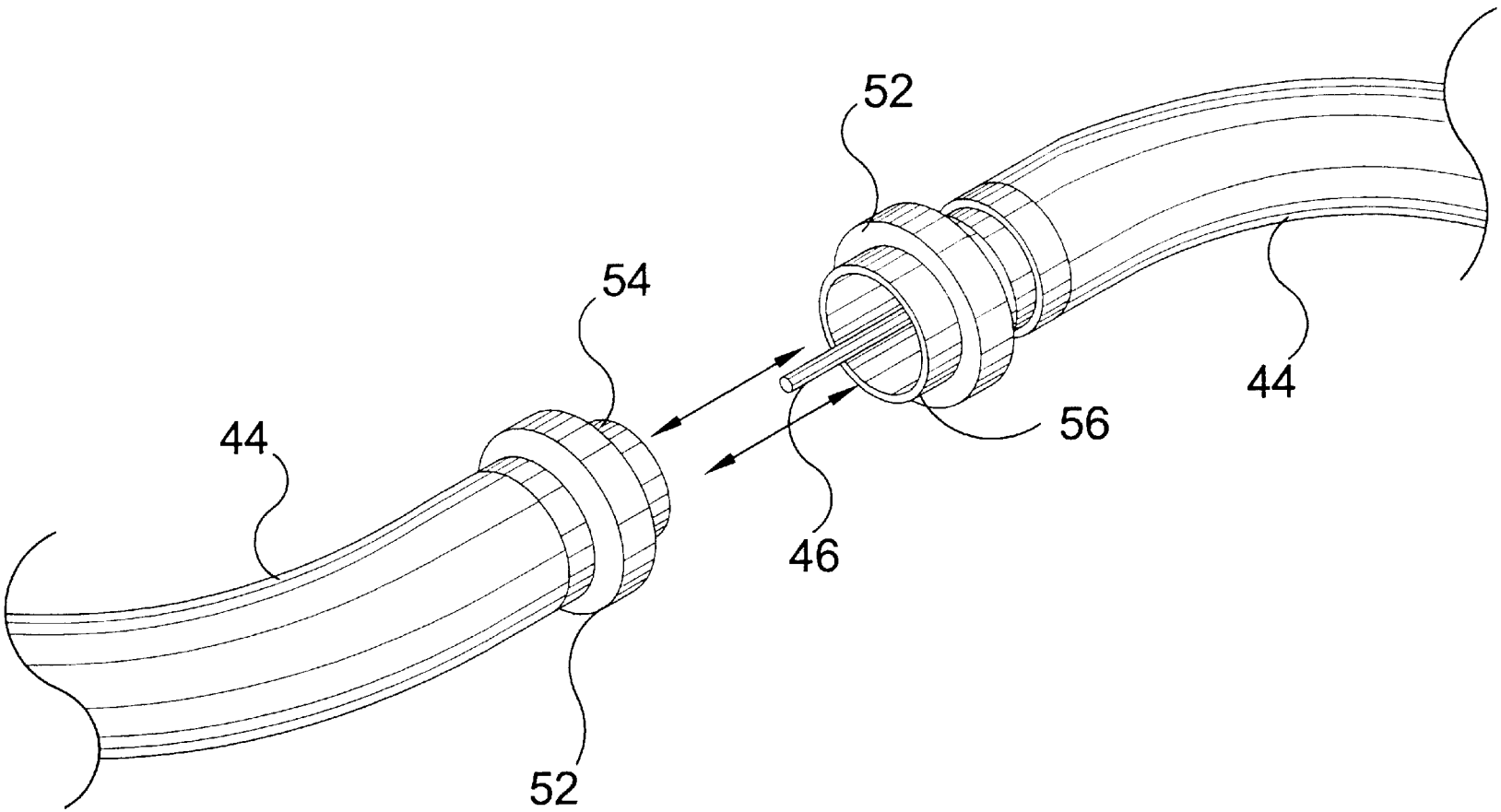
FIG. 11 is a perspective view of the present invention as applied to a coaxial cable connection.

Turning to FIG. 11, shown therein is a perspective view demonstrating how the present invention can be adapted as a connection means for other types of cable applications including the coaxial cables 44 shown here wherein the respective magnetic collars 52 are polarized in such a manner so as to attract one another and form a magnetic seal. Shown are the pin connector 46 along with a male and female connecting members 54, 56. Female member 56 forms a sleeve for receiving male member 54 therein.

Figure 12:
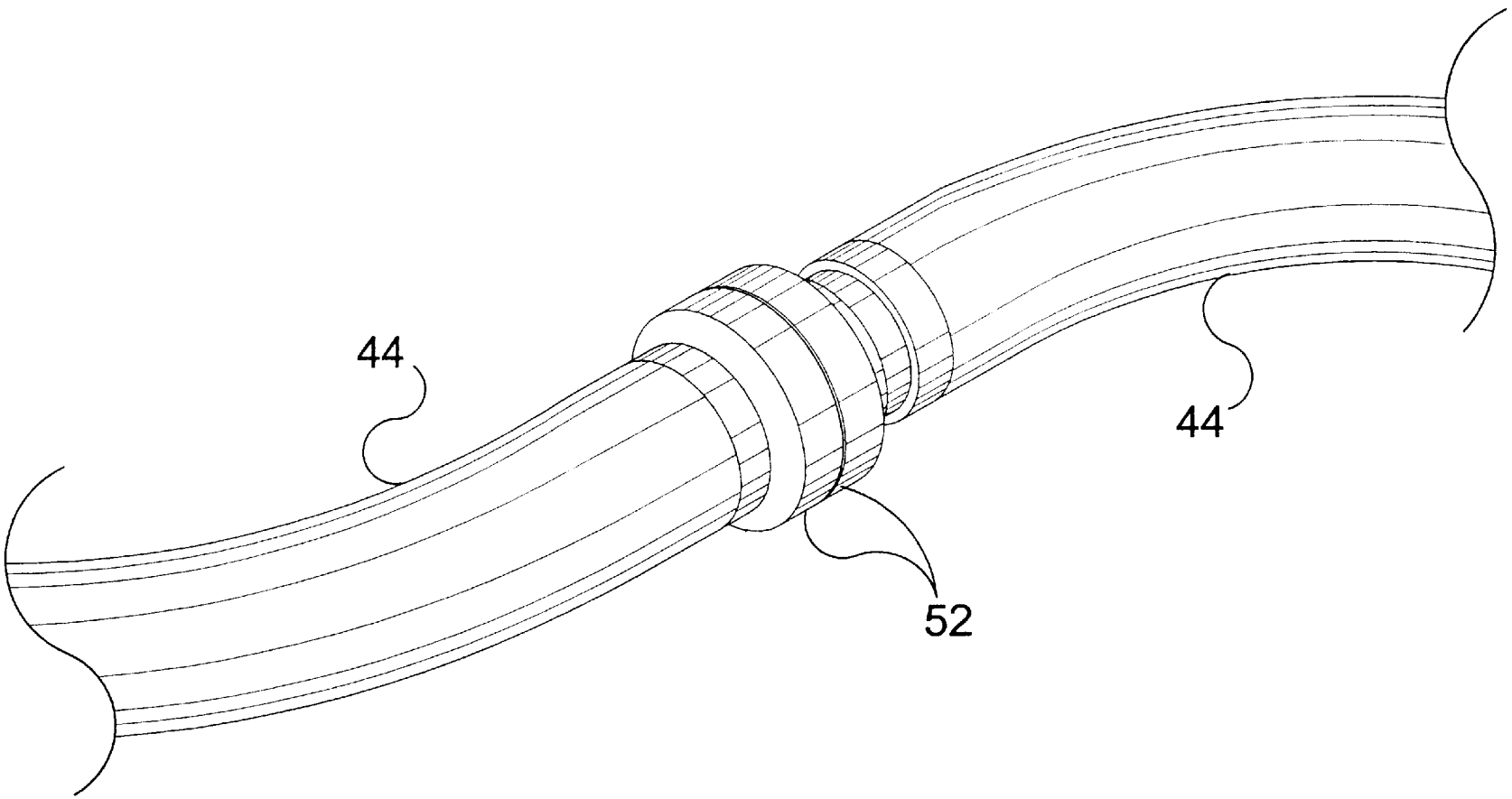
FIG. 12 is a perspective view of the present invention as applied to a coaxial cable connection.

Turning to FIG. 12, shown therein is a perspective view of the present invention applied to coaxial cables 44 showing two cables connected by the magnetic fields holding the magnetic collars 52 together.

Figure 13:
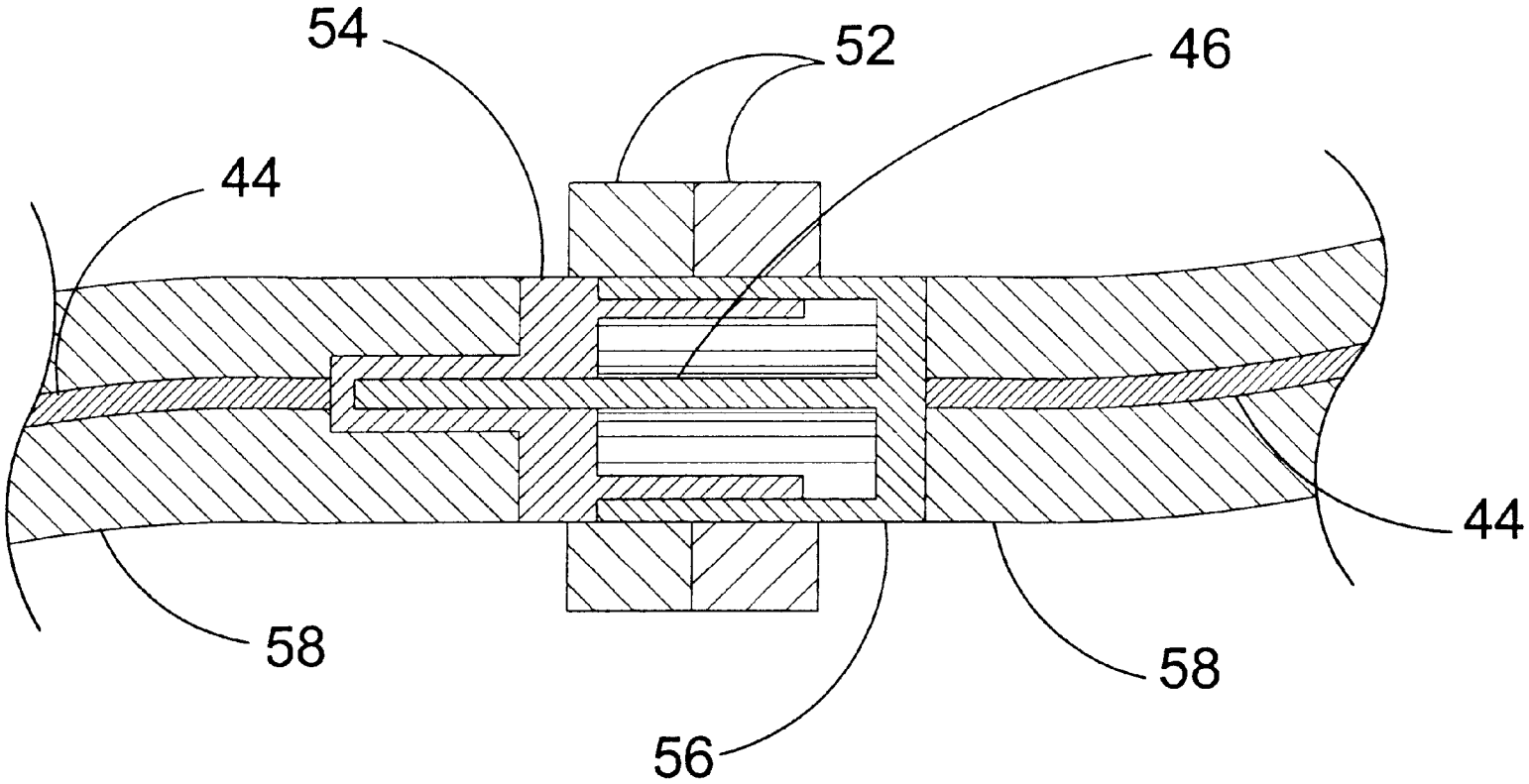
FIG. 13 is a cross sectional side view of the present invention as applied to a coaxial cable connection.

Turning to FIG. 13, shown therein is a cross sectional side view of the present invention as applied to the coaxial cables 44 showing the male insertion member 54 inserted into the female receiving member 56 and being held in connection to each other by the two magnetic collars 52 attracted to one another. Also shown are the connector pin 46 and cable insulation 58.

I claim:

1. An apparatus for connecting the ends of an electrical signal transmission cable, comprising:

a) a jack, said jack being contained in a housing having a first surface on the outside of said jack;

b) a plug, said plug for insertion into said jack, said plug having a second surface on the outside of said plug coextensive with said first surface when said plug is inserted into said jack, said first and second surfaces being separated by a wall of said jack;

c) a first magnetic means disposed on said first surface;

d) a second magnetic means disposed on said second surface whereby said first and second magnetic means are magnetically engaged when said plug is inserted into said jack; and e) a pair of second magnetic means joining said jack and said plug when said plug is inserted into said jack, the second magnetic means on said jack being on a surface facing said plug and the second magnetic means on said plug is on a mounting bracket which remains outside of said jack when said plug is inserted into said jack on a side of said bracket opposite that of the side facing said jack, said pair of second magnetic means being engaged through said bracket.

2. The apparatus of claim 1, wherein said jack is of the RJ-11/14 type.

3. The apparatus of claim 2, wherein said plug is of the RJ-11/14 type.

4. The apparatus of claim 3, wherein said first magnetic means and said second magnetic means further comprise at least one round magnet.

5. The apparatus of claim 4, wherein said first magnetic means and said second magnetic means further comprise at least one generally horizontal magnet.

6. The apparatus of claim 5, wherein said first magnetic means and said second magnetic means further comprise at least one rectangular magnet.

* * * * *